United States Patent [19]

Brown

[11] 4,106,209

[45] Aug. 15, 1978

[54] DRYING VENEER WITH JETS OF SUPERHEATED SOLVENT VAPOR

[75] Inventor: Frederick L. Brown, Midland, Mich.

[73] Assignee: The Dow Chemical Company, Midland, Mich.

[21] Appl. No.: 789,386

[22] Filed: Apr. 21, 1977

[51] Int. Cl.[2] ..... F26B 3/04

[52] U.S. Cl. ..... 34/9.5; 34/16.5; 34/23; 34/29; 34/30; 34/36

[58] Field of Search ..... 34/9.5, 13.4, 13.8, 34/16.5, 23, 29, 30, 36

[56] References Cited

U.S. PATENT DOCUMENTS

| | | | |
|---|---|---|---|
| 112,359 | 9/1914 | Clope | 260/110 |
| 2,884,707 | 5/1959 | Sandback | 34/36 |
| 3,099,541 | 7/1963 | Hildebrand | 34/23 |
| 3,545,094 | 12/1970 | Schuette et al. | 34/23 |
| 3,685,959 | 8/1972 | Dunn, Jr. et al. | 34/9.5 |
| 3,971,139 | 7/1976 | Rochom | 34/36 |

*Primary Examiner*—Leland A. Sebastian

[57] ABSTRACT

Veneer is dried by passing a veneer sheet by at least one set of spaced orifices or nozzles through which jets of superheated organic solvent vapor are directed against one or both of the bottom and top sides of the sheet. After impinging on the wood surface, the spent solvent vapor plus moisture and other volatile substances from the wood passes to a condenser where the solvent is separated and passed to a vaporizer and superheater for recycle to the process. In an optional variation, a preliminary extraction of the entering veneer by condensing solvent is achieved by adjusting the flow rate or temperature of the solvent vapor in the fore part of the drying apparatus. Apparatus for carrying out the veneer drying process with means for recovering and recycling spent solvent is shown.

9 Claims, 2 Drawing Figures

DRYING VENEER WITH JETS OF SUPERHEATED SOLVENT VAPOR

BACKGROUND OF THE INVENTION

This invention relates to a process for drying green wood veneer sheets and to apparatus for carrying out the wood drying process.

Veneer is conventionally dried after being cut from a log by passing the green wood sheets on conveyor means through a large, elongated housing within which air heated by steam or gas burners is circulated so as to contact the top and bottom surfaces of the sheets and thereby remove moisture to the extent desired as well as small amounts of volatile organic materials which are present. In recent years, the process and apparatus have been modified to obtain more efficient drying by directing the hot air against the surfaces of the veneer as multiple small jets. Such modified apparatus is shown in Morris, U.S. Pat. Nos. 3,314,164; 3,334,421; and 3,418,727.

Hot air drying of veneer in general has the disadvantage that resin, pitch, and other organic materials volatilized from the wood during the drying process turn the exhaust air from the vent stack into a characteristic plume of blue haze. Even from an operation of moderate size, the volume of haze thus generated is not only unsightly, but is also a considerable source of highly undesirable air pollutants as well as a waste of potentially valuable organic substances. The exhaust haze can be reduced by use of a water scrubber although this treatment is not entirely effective and a particular problem is the deposition on scrubber wall surfaces of tenacious coatings of gummy and varnish-like solids.

Wood has been dried by application of hot solvent vapors, as shown by Hudson, U.S. Pat. Nos. 2,273,039 and 2,435,219, for example. These processes are designed for lumber, timbers, and poles and are carried out in sealed chambers, sometimes pressurized and sometimes at reduced pressure. The solvents employed are limited to those having a boiling point above 100° C. Such methods are not adapted to drying veneer which is commercially done in line on a continuous or semi-continuous basis.

SUMMARY OF THE INVENTION

According to the present invention, green veneer is efficiently and conveniently dried by contacting at least one surface of the veneer sheet with spaced apart multiple jets of the superheated vapor of a water-immiscible organic solvent, preferably one which forms an azeotrope with water. After impinging on the wood surface, the spent vapor plus vaporized water and volatile organic substances from the wood passes to condensing means where the mixed vapors are condensed. Optionally, the drying process may be carried in two stages wherein the solvent vapor first impinging on the veneer may be allowed to condense at least in part in an extraction stage and the condensed solvent plus liquid water and any dissolved wood extractives are drained off and collected for separation and recovery. The superheated vapor drying process then follows as the main drying stage. Recovered solvent is conveyed to a vaporizer and superheater for recycle to the process. In a preferred mode, the process is operated at a superheat temperature of at least about 100° C using a chlorinated aliphatic hydrocarbon solvent which forms a water azeotrope containing a substantial proportion of water.

Examples of such solvents include ethylene dichloride, 1,1,2-trichloroethane, trichloroethylene, and perchloroethylene.

DETAILED DESCRIPTION

Figure 1:
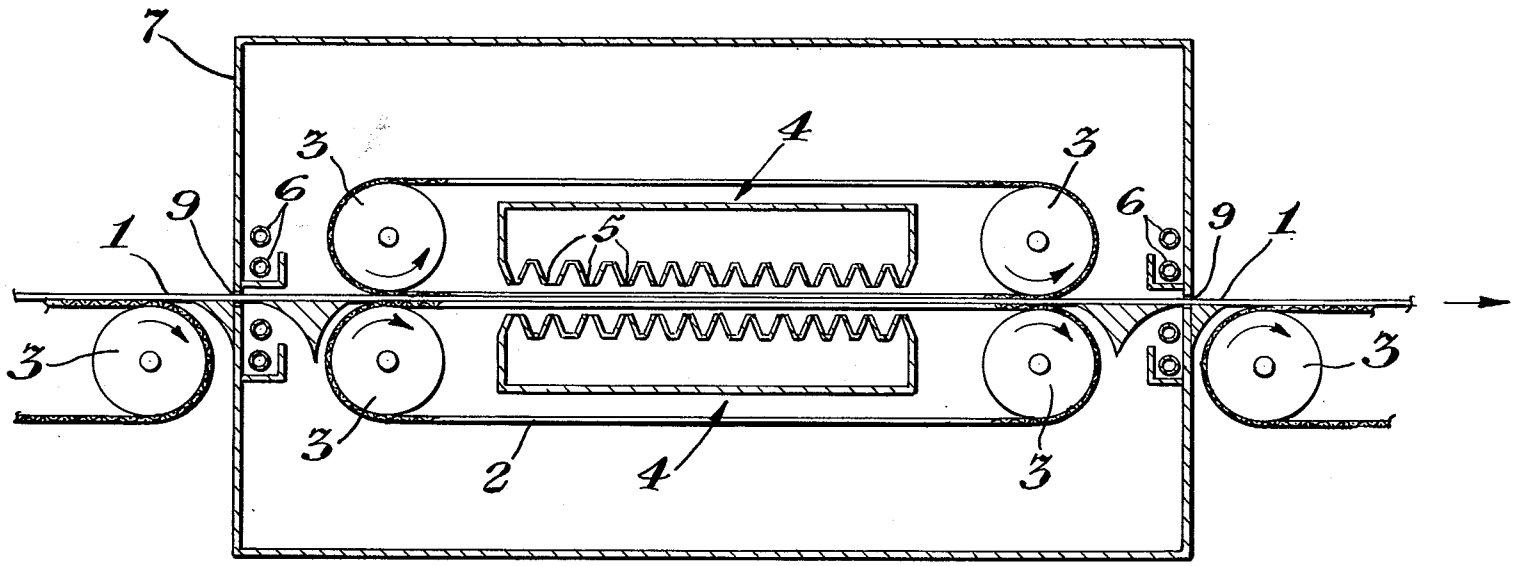
FIG. 1 is a side section semi-schematic view of an enclosed veneer drying apparatus using a preferred mode of the present invention wherein a veneer sheet is conveyed on an endless belt between two opposed banks of solvent vapor jets or nozzles.

In a preferred mode of applying the invention illustrated by FIG. 1, the green veneer sheet 1 is carried through entry slot 9 in the enclosing housing 7 on an endless belt 2 conveyor or series of conveyors of wire mesh, cables, or the like moved by rollers 3 between two opposed banks or headers 4 having multiple spaced apertures 5 through which jets of solvent vapor superheated by an external vaporizer and heater (not shown) are directed against the top and bottom surfaces of the sheet. Alternatively, the header 4 can include a heat exchanging grid which superheats the solvent vapor and may also subdivide the heated vapor as it passes through into multiple spaced jets. Spent solvent vapor plus moisture and other volatiles from the wood is condensed by cooling coils 6 near entry and exit slots 9 and the condensate is taken via recovery lines (not shown) to a separator (not shown) where the solvent is separated from the water vaporized from the wood veneer. The thus recovered solvent can then be recycled to the process. Where it is desirable and practical to do so, wood extractives can be recovered from either or both of the separated solvent and water layers.

Figure 2:
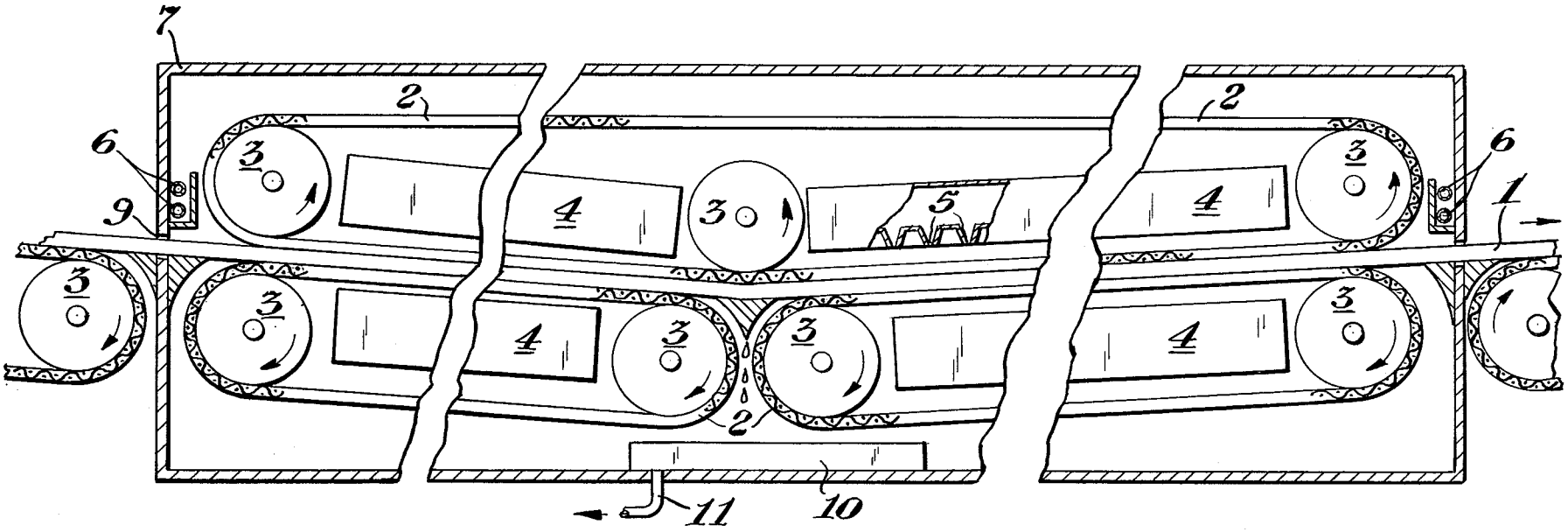
FIG. 2 shows a similar apparatus employing the optional preliminary solvent extraction step.

In another mode of the invention illustrated by FIG. 2, the veneer entering at ambient temperature is contacted in a first stage by solvent vapor at conditions of temperature and rate of vapor flow such that a significant part of the initially contacting vapor is condensed on the wood surface and there is insufficient heat at that point to revaporize the bulk of the condensed liquid. This hot condensed solvent then remains in contact with the veneer long enough for an effective extraction of soluble organic compounds in the wood so that dissolved extractives are easily recoverable from the collected condensate run-off. This preliminary extraction step can be carried out in the fore part of the drying apparatus or in a separate apparatus from which the extracted and partially dried veneer sheet passes directly into the main drier as a second stage. FIG. 2 shows an apparatus adapted to this optional variation of the process wherein the entering veneer sheet 1 passes between downwardly inclined opposed banks 4 of vapor jets 5 and thence between upwardly inclined opposed banks of vapor jets. Condensed solvent runs down the inclined entering veneer sheet to near the low point and runs or drips off together with any water from the veneer into a collector 10 from which the mixed liquid is passed through a drain 11 to separator and solvent recovery means (not shown) where the wood extractives are separated and recovered solvent can be recycled to the process.

Depending upon whether FIG. 2 represents a separate extraction apparatus or an apparatus combining the extraction and drying steps, the upwardly inclined opposed banks 4 of vapor jets 5 can deliver either solvent vapor at the same temperature as that from the downwardly inclined banks 4, that is, at or only slightly above the boiling point of the solvent, or superheated solvent vapor which will dry the extracted veneer with little or no condensation of liquid solvent on its surface.

The present process is operable with any water-immiscible organic solvent, preferably one which forms a water azeotrope. For obvious reasons, solvents which are either essentially non-flammable or have flash points above the temperature to which their vapors are superheated are preferred. Chlorinated aliphatic hydrocarbons are a practical choice. Lower boiling members of this class such as methylene chloride and 1,2-dichloroethylene can be used successfully at vapor temperatures as low as 60°–100° C and the even lower boiling water azeotropes are formed and flash off the heated wood surface as a water removal means. However, these lower boiling chlorinated solvents typically form water azeotropes containing only about 1–4 percent by weight water so that azeotropic removal of water is a lesser factor in the drying process. This fact and particularly the relatively low vapor pressure of water at the temperatures at which these solvents condense on the wood surface tend to make a slow drying process.

Faster and more effective drying is obtained by using a chlorinated solvent having a boiling point of about 80°–125° C and a superheated vapor temperature of about 100°–250° C. Solvents such as ethylene dichloride, 1,1,2-trichloroethane, trichloroethylene, and perchloroethylene form azeotropes containing up to nearly 20 percent by weight of water and boiling within the range of 70°–90° C. A superheated vapor temperature of about 125°–200° C is preferred.

The present process apparently operates in successive stages of heating and water vaporization from the green wood veneer. As the cold veneer sheet enters the drying apparatus through the entry slot 9 and is first contacted by superheated solvent vapor, some solvent is momentarily condensed on the entering cool surface and it thereby heats the veneer rapidly by the liberated latent heat. As previously explained, this solvent condensation phase can be expanded to provide a preliminary extraction of the wood by the solvent condensate. As the veneer sheet passes further into the drying apparatus, it is heated progressively higher so that contained moisture begins to vaporize at least in part as an azeotrope with the solvent condensate. Because the azeotrope boils below 100° C, drying of the veneer thus is begun below the boiling point of water and azeotrope formation proceeds to facilitate and speed up the entire drying process.

Referring particularly to FIG. 1, the shape, size, and spacing of the apertures 5 in the headers 4 can be varied within fairly broad limits. Thus, either round holes or slots can be used with preferred diameters of about 0.1–0.3 inch. These can be spaced apart regularly with minimum spacing of about 0.5 inch or as sets or groups of apertures spaced relatively closely within each set but with the sets spaced 6–12 inches apart, for example. A metal screen or perforated sheet can comprise a set of apertures in the header face. Preferably, the apertures are spaced fairly close to the veneer surface, a spacing of about 0.5–1 inch being the usual practice. Best results are obtained when the jets of superheated vapor strike the veneer surface substantially at a 90° C angle.

This veneer drying process provides other advantages derived from the use of solvent vapor rather than air. A particularly valuable advantage is the production of veneer having a clean, sound wood surface with none of the oxidative degradation often found on a veneer surface dried by hot air. The dried veneer is thus easily wet by pressure-sensitive and hot melt adhesives and readily forms sound bonds with other laminae. It is also particularly adapted to other wood treatment processes such as dyeing, addition of preservatives or insecticides, and impregnation by a heat-curable monomer, especially as these secondary treatments involve the use of a solvent solution.

Such veneer treatments can be applied to veneer fully dried by the present process or they can be employed as intermediate treatments of partially dried veneer by using multiple units of the type illustrated by FIG. 1. In this variation of the process, veneer is partially dried to a moisture content of about 10–25 percent, for example, in a first superheated solvent vapor unit, then treated with a wood additive such as named above, and finally dried and, optionally, the wood additive fixed in the veneer as well, by passage through a second superheated solvent vapor drying unit of the present invention to a final water content of about 2–8 percent. The two units described in this variation of the drying process are, of course, independently adjusted as necessary in drying time and temperature to obtain the desired results.

A further advantage offered by this new drying process is the easy recovery of wood by-products, particularly when the preliminary extraction illustrated by FIG. 2 is employed as a step in the process. In present veneer drying by hot air, organic substances volatilized from the wood are primarily a source of undesirable air pollution and their presence in the exhaust air is now required to be minimized by use of scrubbers or other means of removal. In the present process, resinous or other solvent soluble volatiles are collected in the condensed effluent solvent and are readily separated as a residue from the recovered solvent vaporizer. Similarly, some of the water-soluble volatiles are collected in the aqueous layer in the condensed effluent.

EXAMPLE 1

A laboratory solvent vapor degreaser was modified by the addition of more water-cooled condenser surface near the top, the provision of ports on opposite sides near the bottom for the mounting of opposed superheat vapor guns, and a sheet metal housing enclosing the zone between the guns with an opening at the top for the introduction of wood samples midway between the guns, this opening also serving as an exit for spent solvent vapor. Thermocouples on either side of the wood sample measured the temperature of the superheated solvent vapor coming from the superheat guns. The superheat guns were substantially as described in U.S. Pat. No. 3,851,146 and consisted essentially of a coil of 0.25 inch stainless steel tubing which served as an electrical resistance heater for vaporizing and superheating solvent fed into it. The coil outlet was a stainless steel nozzle of about 1.5 inch diameter with eight vapor outlet holes of about one-eighth inch diameter spaced about its perimeter.

Perchloroethylene was fed through each superheat gun at a rate of about 0.5 lb per minute with the heat adjusted to provide a vapor temperature of 150° C. The wood specimen was suspended between the two superheated vapor outlets with a distance of about 1.5 inches between the wood surface and the gun outlet on each side. The specimen was a four-inch square of two $\frac{1}{8}$ inch plies of Douglas fir glued together with a resorcinol-formaldehyde adhesive and with a thermocouple in the glue line between plies. It was soaked in water to about 25 percent water content based on the weight of dry wood to simulate green wood. The wood temperature during the drying process was as follows:

| Time, min. | 1 | 2 | 3 | 4 | 5 | 6 | 7 |
|---|---|---|---|---|---|---|---|
| Temp., ° C | 85 | 108 | 116 | 119 | 121 | 123 | 125 |

Perchloroethylene condensed briefly on the wood surfaces in about the first two minutes. The wood was essentially free of water after about two minutes and contained only a trace of residual solvent when it was removed from the apparatus at seven minutes. The wood surfaces were smooth and retained their original appearance and color.

EXAMPLE 2

The procedure of Example 1 was repeated using a sample of ponderosa pine wet to contain 103 percent moisture. This sample was made up with two 1/16 inch plies and a thermocouple in the glue line as before:

| Time, min. | 1 | 4 | 6 | 8 | 10 | 12 | 14 |
|---|---|---|---|---|---|---|---|
| Temp., ° C | 100 | 101 | 101 | 101 | 102 | 108 | 125 |

The higher moisture content required a longer drying time, about ten minutes for water removal. As before, the wood surfaces were smooth and undiscolored after drying.

EXAMPLE 3

The above procedure was repeated with a 2-ply western red cedar sample made up as described in Example 1 and containing about 28 percent moisture:

| Time, min. | 1 | 2 | 3 | 4 | 5 |
|---|---|---|---|---|---|
| Temp., ° C | 35 | 87 | 105 | 115 | 125 |

This wood dried very rapidly. The dried wood was unchanged in appearance.

When the above procedures are repeated using sheets of green veneer of these and other species of wood, similar results are obtained. The dried veneer sheets are similarly smooth surfaced and undiscolored.

I claim:

1. A process for drying a green veneer sheet which comprises contacting at least one surface of said sheet with multiple spaced jets of the superheated vapor of a water-immiscible organic liquid, recovering the vapor of said liquid after contacting the veneer sheet, and recycling the recovered vapor to the process.

2. The process of claim 1 wherein the vapor of the organic liquid is superheated to at least about 100° C.

3. The process of claim 1 wherein the organic liquid forms an azeotrope with water.

4. The process of claim 3 wherein the organic liquid is a chlorinated aliphatic hydrocarbon.

5. The process of claim 4 wherein a generally horizontally disposed sheet of green veneer is contacted on both top and bottom surfaces by opposed banks of multiple spaced jets of chlorinated aliphatic hydrocarbon vapor superheated to a temperature of about 60°–250° C.

6. The process of claim 5 wherein the chlorinated aliphatic hydrocarbon is methylene chloride, 1,2-dichloroethylene, ethylene dichloride, 1,1,2-trichloroethane, trichloroethylene, or perchloroethylene.

7. The process of claim 6 wherein the chlorinated aliphatic hydrocarbon is perchloroethylene and the superheated vapor temperature is about 125°–200° C.

8. The process of claim 1 wherein the veneer is partially dried by a first superheated vapor drying process, the partially dried veneer is treated with a wood additive, and the partially dried veneer containing the wood additive is then dried by a second superheated vapor drying process.

9. The process of claim 1 wherein the green veneer is first contacted with vapor of the organic liquid under conditions whereby at least a substantial part of the contacting vapor forms a liquid condensate on the veneer and said condensate is drained off the veneer prior to the superheated vapor drying process.

* * * * *